US009095216B2

(12) United States Patent
Miller

(10) Patent No.: US 9,095,216 B2
(45) Date of Patent: Aug. 4, 2015

(54) ALWAYS LEVEL FOLDING CHAIR

(76) Inventor: Greg Miller, St. Charles, MO (US)

( * ) Notice: Subject to any disclaimer, the term of this patent is extended or adjusted under 35 U.S.C. 154(b) by 343 days.

(21) Appl. No.: 13/560,174

(22) Filed: Jul. 27, 2012

(65) Prior Publication Data

US 2013/0026799 A1 Jan. 31, 2013

Related U.S. Application Data

(60) Provisional application No. 61/574,256, filed on Jul. 29, 2011, provisional application No. 61/630,142, filed on Dec. 5, 2011.

(51) Int. Cl.

| | |
|---|---|
| ***A47C 4/04*** | (2006.01) |
| ***A47C 7/00*** | (2006.01) |
| ***A47C 4/46*** | (2006.01) |

(52) U.S. Cl.

CPC . *A47C 7/008* (2013.01); *A47C 4/04* (2013.01); *A47C 4/46* (2013.01)

(58) Field of Classification Search

CPC ..... A47C 4/04; A47C 4/46; A47C 7/008
USPC ..... 297/29, 41, 59, 344.18
See application file for complete search history.

(56) References Cited

U.S. PATENT DOCUMENTS

| | | | | |
|---|---|---|---|---|
| 534,501 | A | | 2/1895 | Evers |
| 1,694,933 | A | | 12/1928 | Walker et al. |
| 1,730,895 | A | | 10/1929 | Ness |
| 1,869,365 | A | | 8/1932 | Corduan |
| 1,876,479 | A | | 9/1932 | Weller |
| 1,916,772 | A | | 7/1933 | Pratt |
| 1,963,708 | A | | 6/1934 | Marvin |
| 2,110,519 | A | | 3/1938 | Croft |
| 2,450,783 | A | | 10/1948 | Collins |
| 2,505,702 | A | | 4/1950 | Benjamin |
| 2,699,557 | A | | 1/1955 | Gravatt |
| 2,732,006 | A | | 1/1956 | Crescent |
| 2,809,047 | A | | 10/1957 | Strohmaier |
| 3,137,511 | A | * | 6/1964 | Weil et al. ..... 297/59 |
| 4,030,781 | A | | 6/1977 | Howard |
| 4,251,107 | A | | 2/1981 | Sato |
| 4,367,894 | A | | 1/1983 | Manuel |
| 5,078,451 | A | | 1/1992 | Sobel |
| 5,087,095 | A | | 2/1992 | McFate |
| 5,110,184 | A | | 5/1992 | Stein et al. |
| 5,244,249 | A | | 9/1993 | Tseng |
| D361,683 | S | | 8/1995 | Juhl |
| 5,464,268 | A | | 11/1995 | Levrangi |
| 5,503,456 | A | | 4/1996 | Rossini |
| 5,584,529 | A | | 12/1996 | Cheng |

(Continued)

*Primary Examiner* — Anthony D Barfield
(74) *Attorney, Agent, or Firm* — Polster Lieder

(57) ABSTRACT

A chair is provided that is configurable to provide a substantially horizontal seating surface when the chair is disposed on an angled ground surface. The chair comprises a back frame having a pair of telescoping back legs including an upper back leg tube and a lower back leg tube slidingly disposed within the upper back leg tube. The chair additionally includes a pair of locking mechanisms comprising a locking key that includes a locking aperture through which the respective lower back leg tube extends. Each locking mechanism is structured and operable to selectively position the respective locking key in an engaged position that binds the lower back leg tube such that the lower back leg tube cannot slide into the upper back leg tube, and a disengaged position that allows the lower back leg tube to freely slide within the upper back leg tube.

3 Claims, 14 Drawing Sheets

(56) References Cited

U.S. PATENT DOCUMENTS

| | | | | |
|---|---|---|---|---|
| 5,588,695 | A | 12/1996 | Gomes | |
| 5,588,696 | A | 12/1996 | Jay et al. | |
| 5,718,473 | A | 2/1998 | Lynch, Jr. | |
| 5,944,384 | A | 8/1999 | Patterson | |
| 5,988,750 | A | 11/1999 | Rubottom | |
| 6,056,172 | A | 5/2000 | Welsh | |
| 6,056,353 | A | 5/2000 | Meara | |
| 6,089,651 | A | 7/2000 | Carmen | |
| 6,382,727 | B1 | 5/2002 | Pickard | |
| 6,471,288 | B2 | 10/2002 | Alexander, Jr. | |
| 6,547,324 | B1 | 4/2003 | Ammann, Jr. | |
| 6,796,605 | B1 | 9/2004 | Chu | |
| 6,926,355 | B2 | 8/2005 | Le Gette et al. | |
| 7,147,277 | B1 | 12/2006 | Miller | |
| 8,061,766 | B2 | 11/2011 | Miller | |
| 8,459,741 | B2 * | 6/2013 | Mazzola et al. | 297/344.18 X |
| 2002/0145316 | A1 | 10/2002 | Oliver | |
| 2004/0130190 | A1 | 7/2004 | Zheng | |
| 2004/0195879 | A1 | 10/2004 | Amirault | |

* cited by examiner

ALWAYS LEVEL FOLDING CHAIR

CROSS-REFERENCE TO RELATED APPLICATIONS

This application claims the benefit of U.S. Provisional Application No. 61/574,256 filed on Jul. 29, 2011 and Provisional Application No. 61/630,142 filed Dec. 5, 2011. The disclosures of the above applications are incorporated herein by reference in its entirety.

FIELD

The present teachings relate to outdoor, foldable furniture, and in particular to a folding chair that can be placed on an angled surface while providing a substantially horizontal seat position for sitting in by a user.

BACKGROUND

The statements in this section merely provide background information related to the present disclosure and may not constitute prior art.

Many parks, common areas and outdoor entertainment venues have ground seating areas that cover hills or inclines. Typically these seating areas do not employ any fixed seats or chairs. Instead, the user sits directly on the seating areas. To eliminate direct contact between the ground of the seating area and the user's bottom, the user typically positions a blanket or folding chair on the ground for sitting purposes. The blanket and folding chair, however, lie on the seating area at the same angle of the ground of the seating area. Therefore, due to the angled ground surface, the user sits at the angle resulting in uncomfortable sitting position by the user.

Generally, the legs of known folding chairs extend to contact the ground such that when the chair is placed on a sloped surface, seat of the chair is oriented at the angle similar to that of the sloped surface. Hence, when a user sits in a known folding chair that is been placed on a sloped surface, the user is forced to sit in an awkward and/or uncomfortable unorthodox sitting position, as opposed to what is generally considered a standard, comfortable sitting position wherein the user's legs and bottom are oriented in a generally horizontal plane and the user's torso is oriented in a generally vertical position.

Other folding chairs employ collapsible fabric as the seat area. This collapsible fabric conforms to the user's bottom when the user sits within the fabric. Due to the leg configurations of these chairs, the user still sits at the angle of the ground sitting area. Furthermore, due to the angled ground, current folding chairs slip on the angled surface since the legs do not anchor to the ground surface.

SUMMARY

The present disclosure provides a chair that is configurable to provide a substantially horizontal seating surface when the chair is disposed on an angled ground surface. In various embodiments, the chair comprises a back frame having a pair of telescoping back legs including an upper back leg tube and a lower back leg tube slidingly disposed within the upper back leg tube. The chair additionally includes a seat frame pivotally connected to the back frame and a pair of locking mechanisms fixedly connected the upper back leg tubes. Each locking mechanism comprises a locking key including a locking aperture through which the respective lower back leg tube extends. Each locking mechanism is structured and operable to selectively position the respective locking key in each of an engaged position that binds the lower back leg tube such that the lower back leg tube cannot slide into the upper back leg tube, and a disengaged position that allows the lower back leg tube to freely slide within the upper back leg tube.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1A:
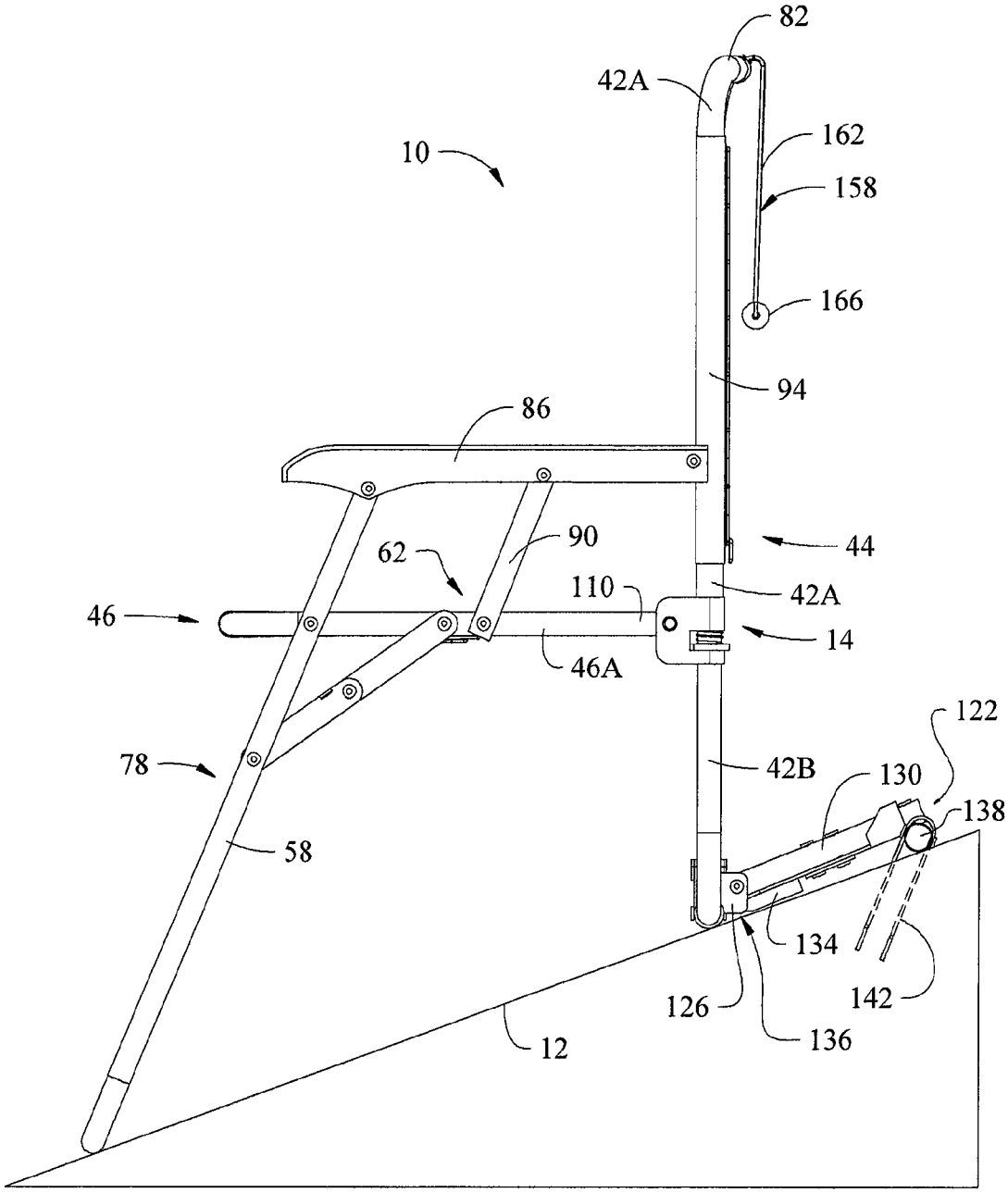
FIG. 1A is a side view of a surface adjustable chair, configured in an expanded position, in accordance with various embodiments of the present disclosure.

The following description is merely exemplary in nature and is in no way intended to limit the present teachings, application, or uses. Throughout this specification, like reference numerals will be used to refer to like elements.

Referring to FIGS. 1A, 1B, 2 and 3, the present disclosure generally provides a surface adjustable chair 10 that is structured and operable to fold and expand, via a plurality of pivot joints including hinges or pivot pin connectors, between a collapsed position (shown in FIG. 1B) and an expanded position (shown in FIG. 1A) to provide a substantially horizontal seating surface for a person to sit while the chair 10 is disposed on an angled or sloped surface 12, e.g., an inclined or declined angled or sloped ground surface. The chair 10 can be of any size to accommodate users of any size.

The chair 10 includes a pair of locking mechanisms 14 structured and operable to lock the chair 10 in any desired configuration suitable to position a seat frame 46 of the chair substantially horizontal while the chair is disposed on an angled or sloped surface 12. The locking mechanisms 14 are also structured and operable to pivotally, or hindgedly, connect a back frame 44 with a seat frame 46 of the chair 10. The respective locking mechanisms 14 are disposed on opposing sides of the chair 10 and are substantially the same in structure and functionality, however for brevity and clarity, generally only various embodiments of a single locking mechanism 14 will be described and illustrated herein.

In various embodiments, each locking mechanism 14 includes a seat bracket 18 connected to a back bracket 22 by a single bolt or pin 26 which allows the seat and back brackets 18 and 22 to pivot relative to each. In such embodiments, each locking mechanism 14 additionally includes a lock 30, comprised of rubber or similar material, that moves freely along an arc within the back bracket 22, but is permanently attached to the seat bracket 18 by locking bolts or pins 34 that travel through slots 38 within the back bracket 22.

As upper tubes 42A of telescoping back legs 42 of the back frame 44 are pulled away from lower tubes 42B of the back legs 42, and the seat frame 46, to which the seat bracket 18 is connected, is pulled away from the back legs 42 and pushed toward the surface 12, e.g., the ground, to transition the chair 10 from a collapsed position (shown in FIG. 1B) to an expanded position (shown in FIG. 1A), the angle between the bottom of a seat frame 46 and the front of the back legs 42 decreases to the point that the lock 30 of each locking mechanism 14 comes into contact with a tongue 50A of a locking key 50 of the respective locking mechanism 14. The lower back leg tubes 42B slidingly extend through each back bracket 22 and a locking aperture 54 in a back end 50B of each locking key 50, such that the contact between the respective locks 30 and locking keys 50 creates pressure that causes each locking key 50 to pinch or bind on to the lower back leg tube 42B. This pinching or binding prevents, or at least greatly restricts, telescopic travel of the lower back leg tube 42B into the upper back leg tube 42A such that the back leg 42 is locked at a certain length L (FIG. 3) and the seat frame 46 is disposed and locked in a substantially level orientation.

Accordingly, regardless of the angle or slope of the surface 12, e.g., from perfectly flat to a steep angle or slope, when a back lower cross member 70 and/or the lower back tubes 42B of the back frame 44, and a front lower cross member 74 and/or front legs 58 of a front frame 78 are in contact with the ground and the upper back leg tubes 42A are pulled to their highest position, the seating frame 46 will automatically lock into a substantially horizontal position. As pressure is applied to the seating frame 46, e.g., pressure applied when a person sits in a seat panel 62 connected to the seat frame 46, the locking mechanism 14 will exert even more pressure onto the locking key 50 and lower back leg tubes 42B making the locking function of the locking mechanism 14 consistently stronger as more weight is applied.

In various embodiments, the locking mechanism 14 further includes a leveling spring 66 that is structured and operable to apply pressure to the back end 50B of the locking key 50 that includes the locking aperture 54. The pressure applied by the leveling spring 66 maintains the locking key 50 in a substantially level position such that the lower back leg tubes 42B are able to smoothly slide within the locking aperture 54 until the lock 30 of each locking mechanism 14 comes into contact with the tongue 50A of the respective locking key 50. That is, the leveling springs 66 prevent 'chattering' of the locking keys 50 on the lower back leg tubes 42B as the chair 10 is transitioned between the collapsed position and an expanded position.

To unlock the locking mechanism 14, the user simply stands up to relieve the pressure of his/her weight off the locking keys 50. The user then can grasp the front of the seat frame 46 and the top of the back frame 44 and simultaneously pull the front of the seat frame 46 and the top of the back frame 44 upward, i.e., vertically away from the surface 12, to disengage the locks 30 locking pins 34 and collapse the chair 10. Subsequently, the chair 10 can be re-folded to the collapsed position for easy portability and storage.

Figure 1B:
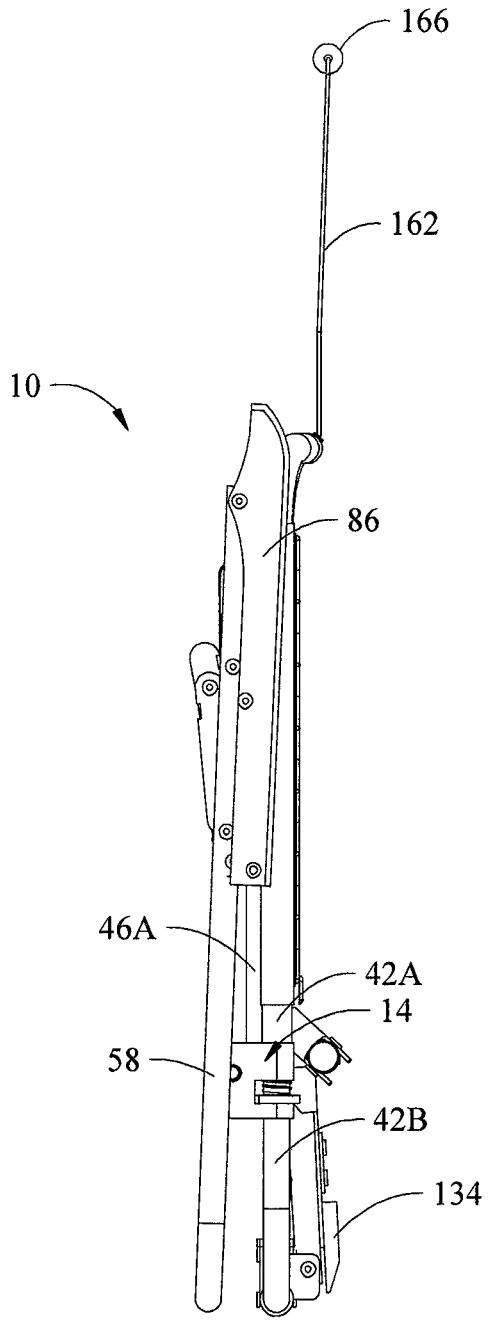
FIG. 1B is a side view of the surface adjustable chair shown in FIG. 1A, configured in a collapsed position, in accordance with various embodiments of the present disclosure.
Figure 2:
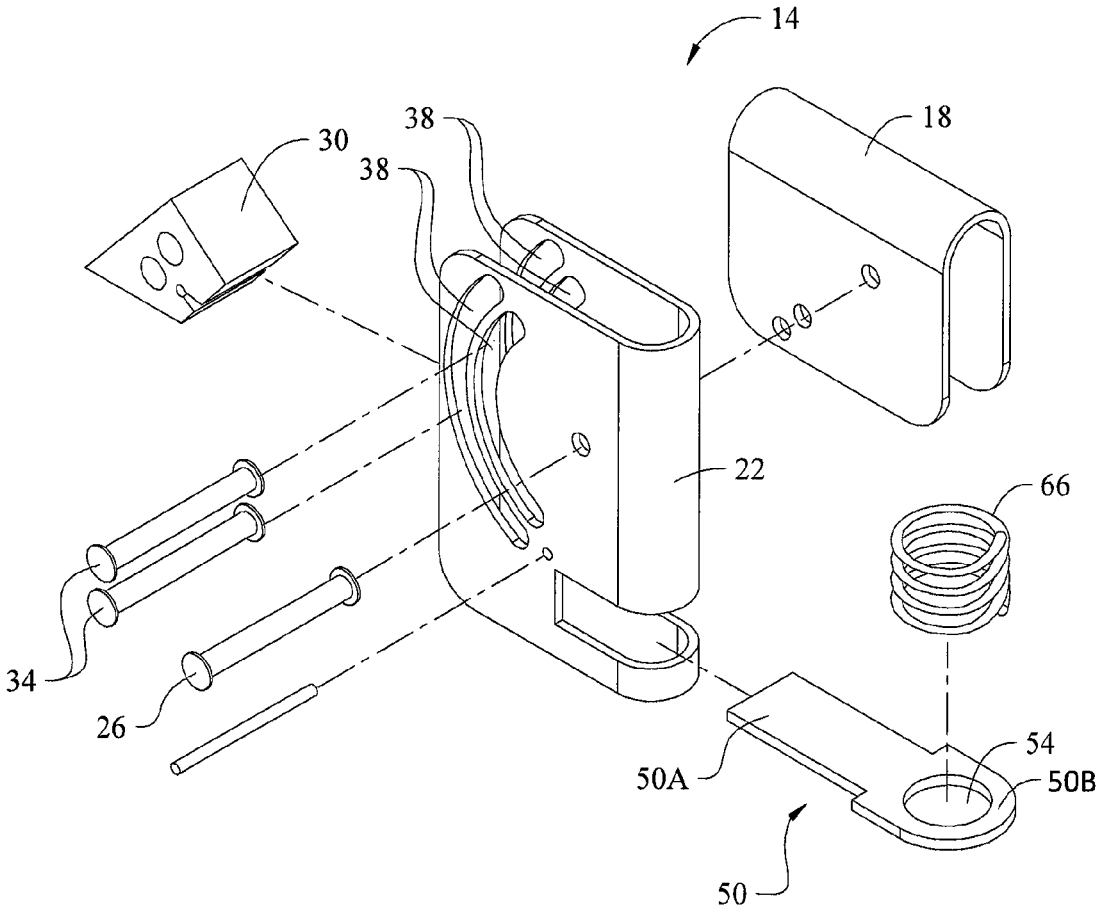
FIG. 2 is an exploded view of a locking mechanism of the chair shown in FIGS. 1A and 1B, in accordance with various embodiments of the present disclosure.
Figure 3:
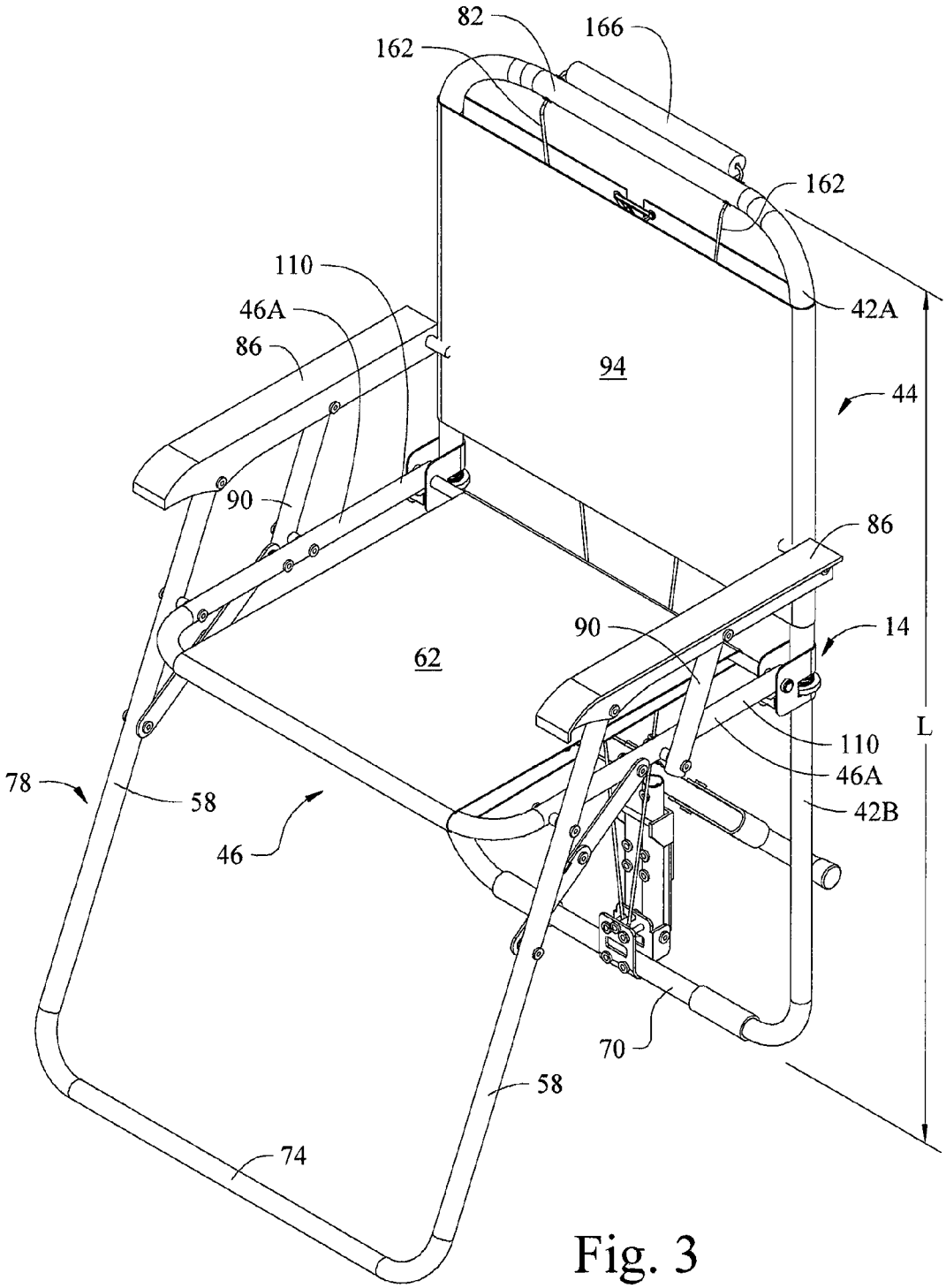
FIG. 3 is an isometric view of the surface adjustable chair shown in FIGS. 1A and 1B, in accordance with various embodiments of the present disclosure.

Referring now to FIGS. 1A, 1B and 3, the back frame 44 additionally includes a back upper cross member 82 formed or connected between the opposing upper back leg tubes 42A. Similarly, the back lower cross member 70 is formed or connected between the opposing lower back leg tubes 42B, and the front lower cross member 74 is formed or connected between the opposing front legs 58. Furthermore, the seat frame 46 is pivotally connected to the opposing back leg tubes 42B at a lower end of the back leg tubes 42B and to the opposing front legs 58, as illustrated throughout the various figures. The chair 10 further includes a pair of opposing armrests 86 that are pivotally connected at respective front portions to upper ends of the front legs 58 and pivotally connected at back ends to the back leg tubes 42B, as illustrated throughout the various figures. Additionally, in various embodiments, each armrest 86 is pivotally connected at a midsection to side tubes 46A of the seat frame 46, via intermediate struts 90.

As illustrated in FIGS. 1A and 1B, the lower back leg tubes 42B are slidingly disposed with the upper back leg tubes 42A in a telescoping manner such that the lower back leg tubes 42B can be collapsed or pushed into the upper back leg tubes 42A, as shown in FIG. 1B, to place the chair 10 in the collapsed position, and extended or pulled out of the upper back leg tubes 42A a length or distance, as shown in FIG. 1A, suitable to place the chair 10 in the expanded position whereby the seat frame 46 is disposed in a substantially horizontal orientation.

In various embodiments, the chair 10 further includes a backrest panel 94 connected to the back frame 44 to provide a backrest for a user sitting in the chair 10. The backrest panel 94 can be fabrication of any material suitable to provide support for the user's back when sitting the chair 10, such as nylon or canvas.

Figure 4A:
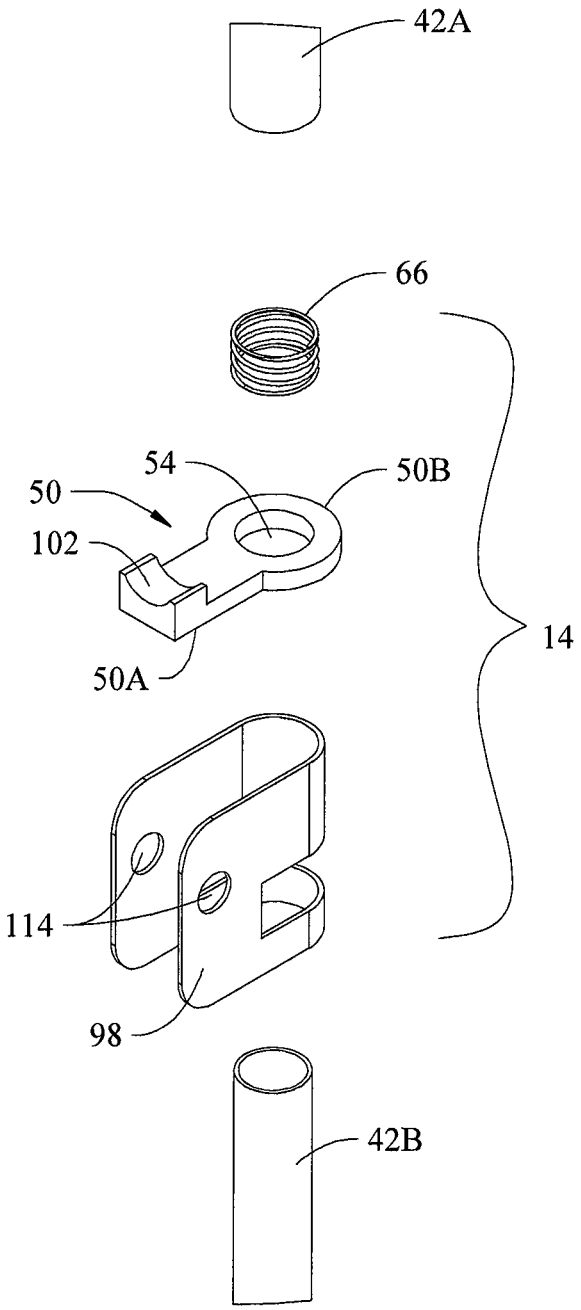
FIG. 4A is an exploded view of the locking mechanism of the chair shown in FIGS. 1A and 1B, in accordance with various other embodiments of the present disclosure.
Figure 4B:
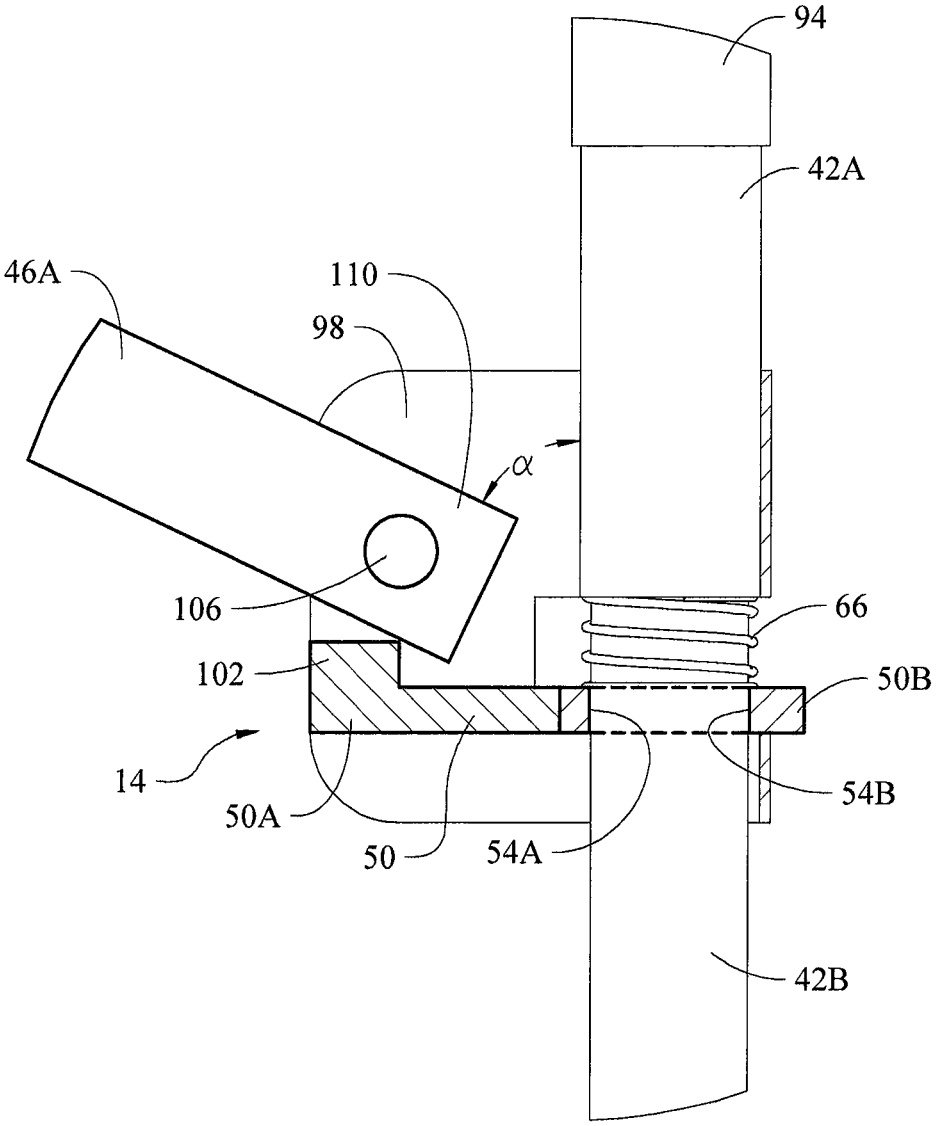
FIG. 4B is side view of the locking mechanism shown in FIG. 4A being configured in a disengaged position, wherein one half of a hinge bracket is removed from view for clarity, in accordance with various embodiments of the present disclosure.
Figure 4C:
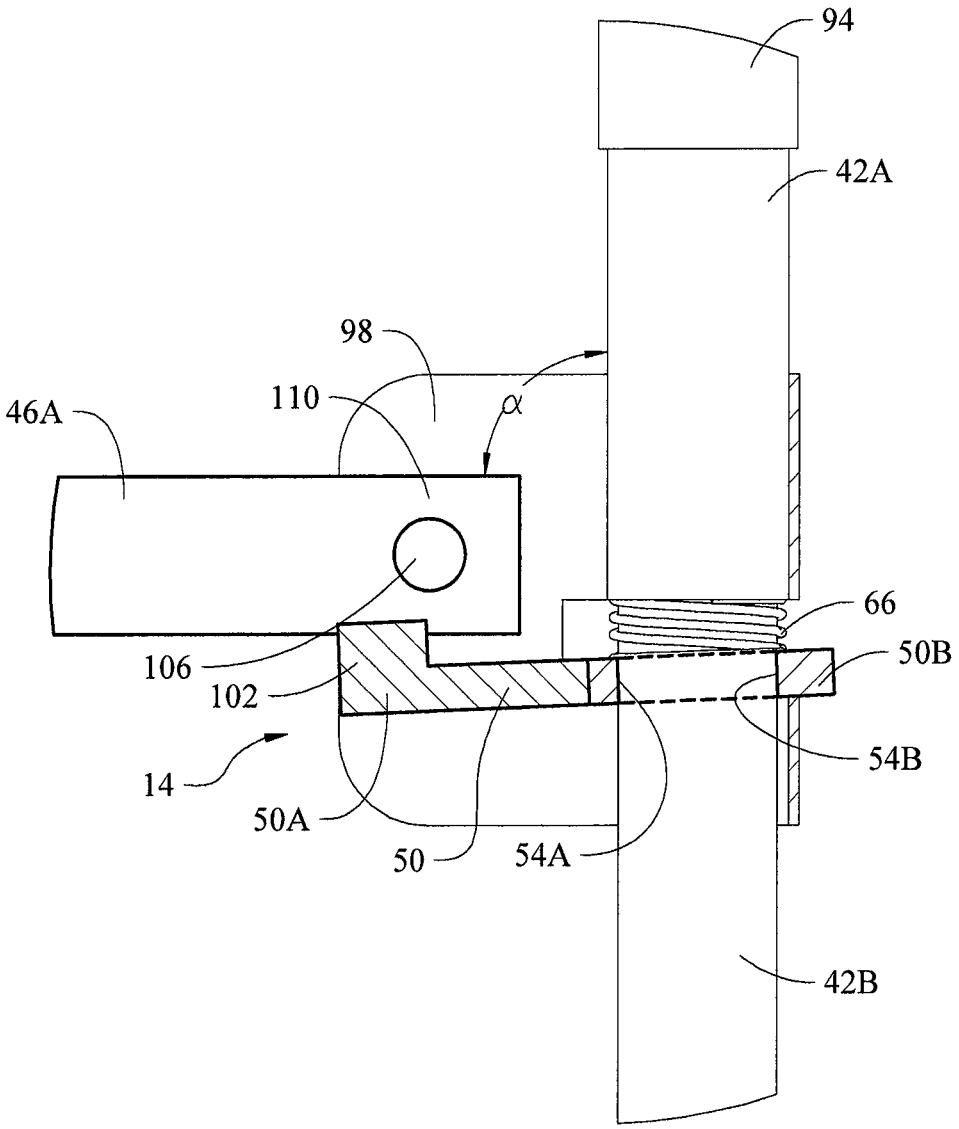
FIG. 4C is side view of the locking mechanism shown in FIG. 4A being configured in an engaged position, wherein one half of a hinge bracket is removed from view for clarity, in accordance with various embodiments of the present disclosure.

Referring now to FIGS. 3, 4A, 4B and 4C, in various embodiments, the locking mechanism 14 comprises a hinge bracket 98 that is fixedly attached to the lower end of the upper back leg tube 42A and at least partially encloses, in a non-contact manner, the portion of the lower back leg tube 42B that is adjacent the upper back leg tube lower end. Hence, the lower back leg tube 42B can freely telescopingly slide into and out of the upper back leg tube 42A without interference from the hinge bracket 98. As described above, the locking mechanism 14 includes the locking key 50 and the leveling spring 66, however, in such embodiments as illustrated in FIGS. 4A, 4B, and 4C, the locking key 50 includes a fulcrum pad 102 integrally formed with, or disposed on, the tongue 50A of the locking key 50. Furthermore, in such embodiments, a terminal end 110 of each opposing seat frame side tube 46A is pivotally connected to the hinge bracket 98 via a hinge pin 106 pivotally extending through opposing apertures 114 in the hinge bracket 98 and the respective seat frame side tube terminal ends 110. Accordingly, the seat frame 46 can pivot upward, as shown in FIG. 4B, to configure the chair 10 in the collapsed position, and pivot downward, as shown in FIG. 4C, to configure the chair 10 in the expanded position.

Particularly, as the seat frame 46 is pivoted downward to configure the chair 10 in the expanded position, the respective seat frame side tube terminal end 110 contacts the fulcrum pad 102 of the respective locking key 50, thereby exerting a downward force on the tongue 50A of the locking key 50 pushing the tongue 50A downward and consequently pushing the back end 50B of the locking key 50 upward. More specifically, the downward force exerted on the fulcrum pad 102 by the respective seat frame side tube 46A causes the locking key aperture 54 to cant such that a leading edge 54A and a trailing edge 54B of the locking aperture 54 pinch or bind the lower back leg tube 42B. Moreover, since the hinge bracket 98 is fixedly formed with, or attached to, the upper back leg tube 42A, this pinching or binding prevents, or at least greatly restricts, telescopic travel of the lower back leg tube 42B into the upper back leg tube 42A such that the back leg 42 is locked at a certain length L (FIG. 3) and the seat frame 46 is disposed and locked in a substantially level orientation.

Figure 4D:
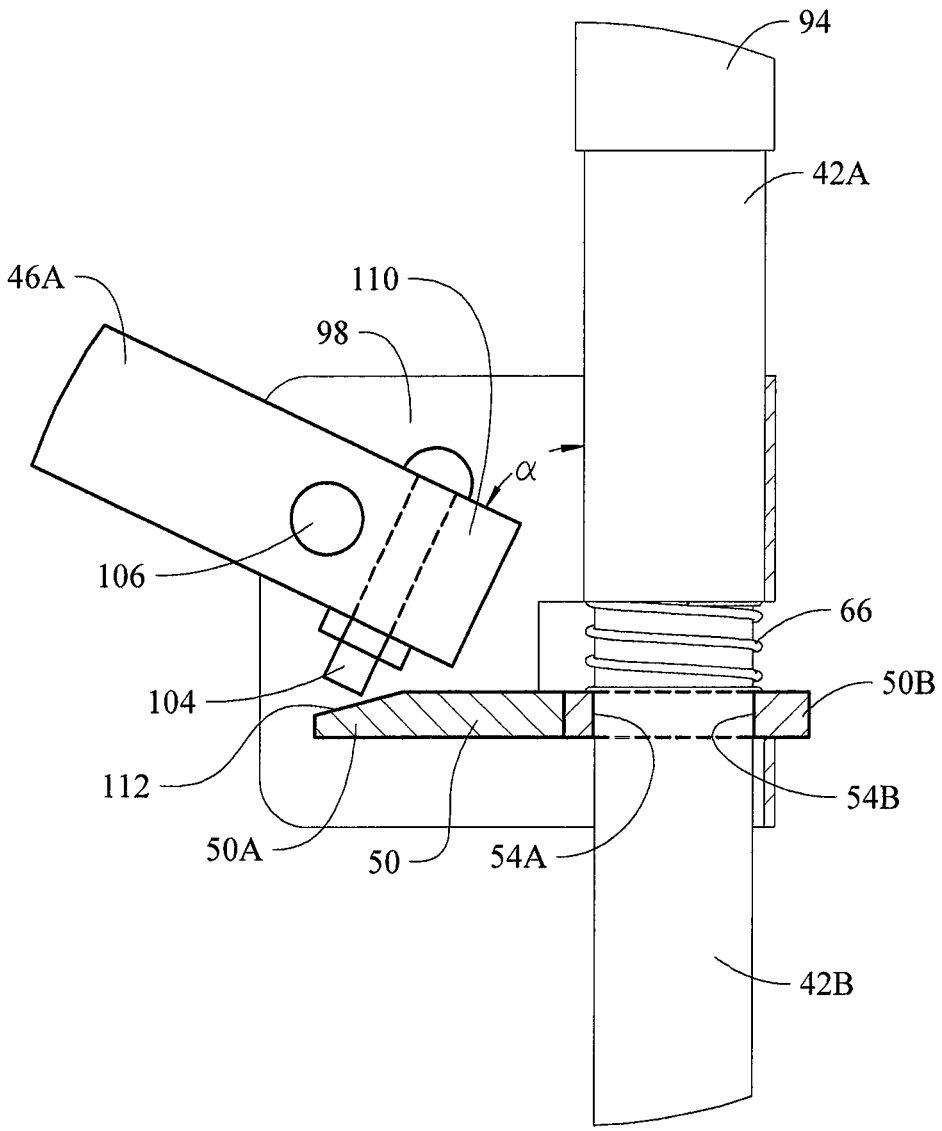
FIG. 4D is a side view of a locking mechanism of the chair shown in FIGS. 1A and 1B, in accordance with still other embodiments of the present disclosure.

Referring now to FIGS. 3, 4A, 4B, 4C and 4D, although, as described above and illustrated in FIGS. 4A, 4B and 4C, in various embodiments the locking key 50 includes the fulcrum pad 102 integrally formed with or disposed on the locking key tongue 50A, whereby the seat frame side tubes 46A contact the fulcrum pad 102 to engage the locking key 50, it is envisioned that in various other embodiments, the locking mechanism 14 can include a fulcrum pin 104 that is disposed at the terminal end 110 of the seat frame side tubes 46A and the locking key tongue 50A can comprise a beveled leading end 112, as illustrated in FIG. 4D. In various implementations the fulcrum pin 104 can be a pin, e.g., a screw, bolt or rivet, that extends through a hole in the terminal end 110 and beyond a lower side of the seat frame side tubes 46A. Alternatively, the fulcrum pin 104 can be any suitable device or component integrally formed with or disposed on the lower side of the terminal ends 110 of the seat frame side tubes 46A to provide a protuberance therefrom.

Therefore, in such embodiments, as the seat frame 46 is pivoted downward to position the chair 10 in the expanded position, the fulcrum pins 104 protruding from the lower side of the seat frame side tube terminal ends 110 contact the locking key beveled leading ends 112, thereby exerting a downward force on the respective tongues 50A. As the seat frame 46 is pivoted further toward the expanded position, the fulcrum pins 104 move along the beveled leading ends 112 onto the flat top surface of the locking key tongues 50A, thereby exerting greater downward force on the respective tongues 50A and consequently pushing the back end 50B of the locking key 50 upward. More specifically, the downward force exerted on the locking key tongues 50A by the respective fulcrum pins 104 cause the locking key apertures 54 to cant such that the leading edge 54A and the trailing edge 54B of the locking aperture 54 pinch or bind the lower back leg tube 42B. Moreover, since the hinge bracket 98 is fixedly formed with, or attached to, the upper back leg tube 42A, this pinching or binding prevents, or at least greatly restricts, telescopic travel of the lower back leg tube 42B into the upper back leg tube 42A such that the back leg 42 is locked at the desired length L (FIG. 3) and the seat frame 46 is disposed and locked in a substantially level orientation.

Referring now to FIGS. 1 through 4D as illustrated in FIG. 1B, when the chair 10 is in the collapsed position, a significant portion of the lower back leg tube 42B is disposed within the upper back leg tube 42A, that is, the lower back leg tube 42B is retracted within the upper back leg tube 42B. Accordingly, to position the chair 10 in the expanded position on a sloped surface, the user simply positions the back lower cross member 70 on the surface 12, e.g., the ground, and pushes the seat frame 46 forward causing the front lower cross member 74 to contact the surface 12. Subsequently, the user steps on the back lower cross member 70 to hold the back lower cross member 70 firmly in contact with the surface 12, and gently pulls upward on the back upper cross member 82 causing the upper back leg tubes 42A to be telescopingly extended upward from the lower back leg tubes 42B, and vice versa. Importantly, as the upper back leg tubes 42A are pulled upward such that an angle $\alpha$ between the upper back leg tubes 42A and the seat frame side tubes 46A increases until the seat frame side tubes 46A contact and apply a downward force to the respective fulcrum pads 102 of the locking keys 50, or alternatively the fulcrum pin 104 contacts and applies a downward force to the respective locking key tongues 50A. As described above, the downward force exerted on locking key tongues 50A by the respective seat frame side tubes 46A cause the locking key aperture 54 to cant such that a leading edge 54A and a trailing edge 54B of the locking aperture 54 pinch or bind the lower back leg tube 42B, thereby preventing, or at least greatly restricting, telescopic travel of the lower back leg tube 42B into the upper back leg tube 42A such that the back leg 42 is locked at a certain length L (FIG. 3) and the seat frame 46 is disposed and locked in a substantially level orientation.

Therefore, regardless of the angle or slope of the surface 12, e.g., from perfectly flat to a steep angle, when the back lower cross member 70 and/or the lower back tubes 42B of the back frame 44, and the front lower cross member 74 and/or front legs 58 are in contact with the ground and the upper back leg tubes 42A are pulled to the desired length L, the seating frame 46 will automatically lock into a substantially horizontal position. Moreover, as pressure is applied to the seating frame 46, e.g., pressure applied when a person sits in a seat panel 62 connected to the seat frame 46, the locking mechanism 14 will exert even more pressure onto the locking key 50 making the locking function of the locking mechanism 14 consistently stronger as more weight is applied.

As described above, in various embodiments, the locking mechanism 14 can include a leveling spring 66 that is structured and operable to apply pressure to the back end 50B of the locking key 50. The pressure applied by the leveling spring 66 maintains the locking key 50 in a substantially level position such that the lower back leg tubes 42B are able to smoothly slide within the locking aperture 54 until the seat frame side tubes 46A contact the fulcrum pads 102. Hence, the leveling springs 66 prevent 'chattering' of the locking keys 50 on the lower back leg tubes 42B as the chair 10 is transitioned between the collapsed position and an expanded position.

As also described above, to unlock the locking mechanism 14, the user simply stands up to relieve the pressure of his/her weight off the locking keys 50. The user then can grasp the front of the seat frame 46 and the top of the back frame 44 and simultaneously pull the front of the seat frame 46 and the top of the back frame 44 toward each other to remove the downward force on the locking key tongues 50A, thereby disengaging the locking key apertures 54 from the lower back leg tubes 42B. Subsequently, the back upper cross member 82 can be pushed downward to telescopingly force the lower back leg tubes 42B into the upper back leg tubes 42B, thereby placing the chair 10 in the collapsed position.

Figure 5:
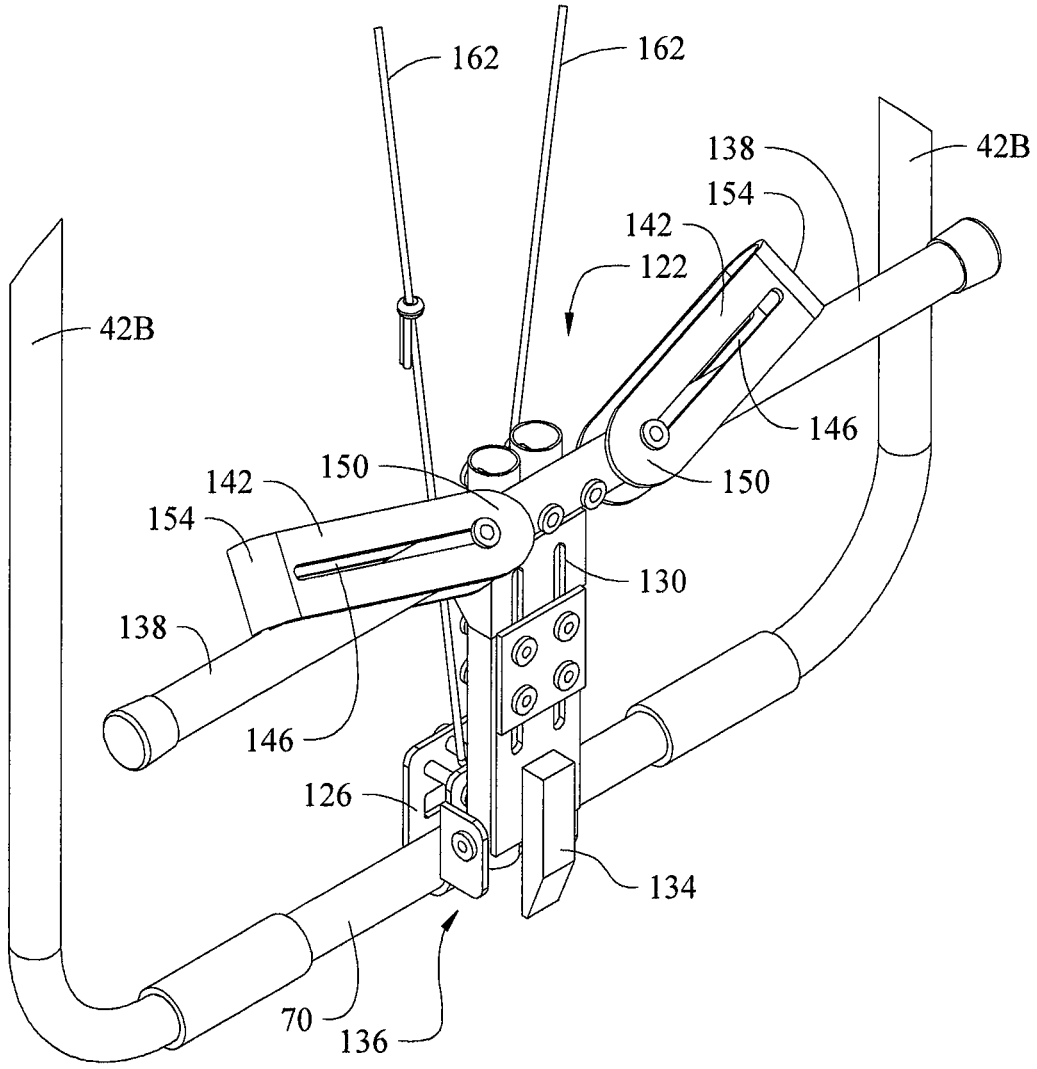
FIG. 5 is an isometric view of an anchoring and stabilizing mechanism of the chair shown in FIGS. 1A and 1B, in accordance with various embodiments of the present disclosure.

Referring now to FIGS. 1A and 5, in various embodiments, the chair 10 can further include an anchoring and stabilizing mechanism 122 mounted to the back lower cross member 70. The anchoring and stabilizing mechanism 122 is structured and operable to selectively provide additional stability to the chair 10 and/or temporary anchoring of the chair 10 to the surface 10. In various embodiments, the anchoring and stabilizing mechanism 122 includes a mounting bracket 126 fixedly attached to the back lower cross member 70, and a kick arm 130 is pivotally mounted at a proximal end to the mounting bracket 126. The pivotal mounting of the kick arm 130 to the mounting bracket 126 allow the kick arm 130 to be selectively position in a stowed position (shown in FIG. 5) or a deployed position (shown in FIG. 1A). The anchoring and stabilizing mechanism 122 additionally includes a locking tongue 134 integrally formed with or fixedly attached to the kick arm 130 and structure and operable to selectively engage a tongue receiver 136 included in the mounting bracket 126 to selectively lock the kick arm 130 in the deployed position.

The anchoring and stabilizing mechanism 122 further includes one or more stabilizing feet 138 mounted to a distal end of the kick arm 130. For example, as shown in Figure, in various implementations the anchoring and stabilizing mechanism 122 can have a single stabilizing foot 138 mounted to the distal end of the kick arm 130 such that opposing ends of the stabilizing foot 138 extend outward from opposing sides of the kick arm 130. Still further, in various embodiments, the anchoring and stabilizing mechanism 122 includes one or more anchoring stakes 142 slidingly and/or pivotally mounted to the stabilizing foot 138.

In operations, once the chair 10 is configured and locked in the expanded position, as described above, the user can move the kick arm 130 from the stowed position to the deployed position whereby the locking tongue 134 securely engages with the tongue receiver 134 such that the kick arm 130 is selectively locked in the deployed position. To return the kick arm 130 to the stowed position, the locking tongue 134 must be disengaged from the tongue receiver 136. Importantly, when the kick arm 130 is locked in the deployed position, the stabilizing foot 138 is in contact with the surface 12, thereby inhibiting side-to-side and front-to-back rocking of the chair 10 and providing additional stability to chair 10. Once the kick arm 130 is locked in the deployed position, the user can selectively position one or more of the anchoring stakes 142 to anchor the chair 10 to the surface 12. Particularly, one or more of the anchoring stakes 142 can be rotated and/or slidingly positioned such that the anchoring stake(s) 142 are oriented such that they can be pushed into the surface 12 to anchor the chair 10 to the surface 12 and provide further stability to chair 10.

For example, in various implementations, the anchoring stake(s) 142 are mounted to the stabilizing foot 138 via slots 146 such that the anchoring stake(s) 142 are pivotally and slidingly mounted to the stabilizing foot 138. In such embodiments, once the kick arm is locked into the deployed position, each anchoring stake 142 can be pivoted upward such that a tip 150 of each anchoring stake 142 is pointed downward toward the surface 12. Thereafter, the user can step on a back end 154 of each anchoring stake 142 to force the respective anchoring stake 142 to penetrate the surface and 'stake', i.e., secure, the chair 10 to the surface 12.

In various embodiments, the chair 10 can include a closing and carrying strap 158 that is structured and operable to selectively maintain the chair 10 in the collapsed position and provide a convenient handle or carrying strap for the user to utilize when transporting, i.e., carrying, the chair 10. The closing and carrying strap 158 includes a cord or strap 162 that is slidingly engaged with the back upper cross member 82 and fixedly connected to the back lower cross member 70. For example, in various implementations, the cord 162 is slidingly inserted through holes (not shown) in the back upper cross member 82 and affixed, e.g., tied, to the mounting bracket 126 of the anchoring and stabilizing mechanism 122 such that a top section of the cord 162 extends beyond the back upper cross member 82. When the chair 10 is in the expanded position at least a portion of cord top section extends beyond the back upper cross member 82. In various implementations the closing and carrying strap 158 can include a handle 166 disposed on the top section of the cord 162. Subsequently, once the chair 10 is configured in the collapsed position, as described above, a greater amount of the top section of the cord 162 extends beyond the back upper cross member 82 providing a handle or shoulder strap that can be utilized by the user to conveniently transport the chair 10. In various embodiments, the closing and carrying strap 158 can be utilized to retain the chair 10 in the collapsed position. That is, by virtue of the cord 162 being fixedly connected to the back lower cross member 70, when the chair is in the collapsed position and the being carried by the closing and carrying strap 158, the weight of the chair will maintain tension on the closing and carrying strap 158, which will in turn apply an upward force on the back lower cross member 70 and the lower back leg tubes 42B. This upward force will dispose and retain the lower back leg tubes 42B within the upper back leg tubes 42A to the maximum potential and not allow the lower back leg tubes 42B to telescopingly extend downward, or outward, from the upper back leg tubes 42A.

Figure 6A:
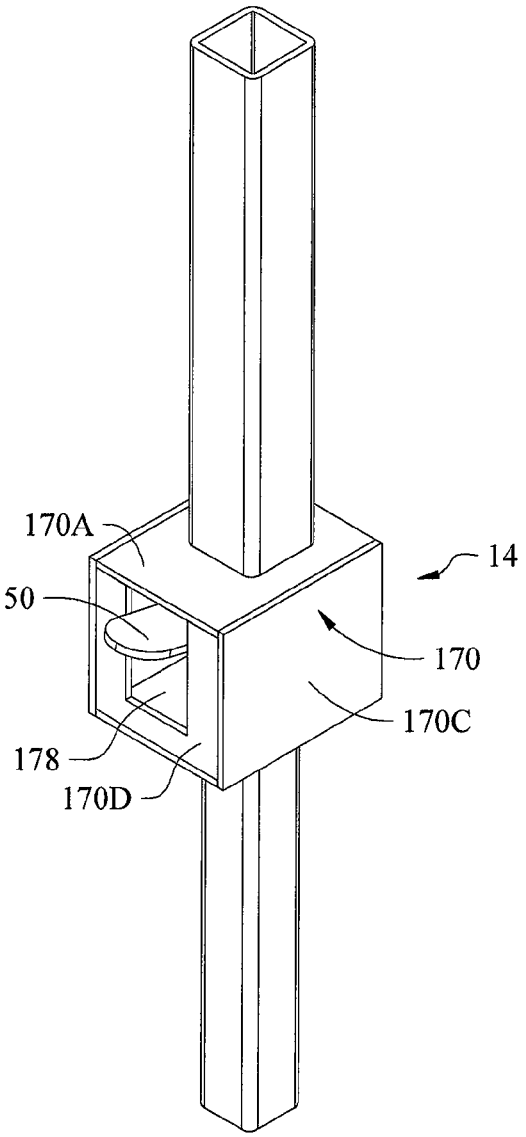
FIG. 6A is an isometric view of the locking mechanism of the chair shown in FIGS. 1A and 1B, in accordance with yet other embodiments of the present disclosure.
Figure 6B:
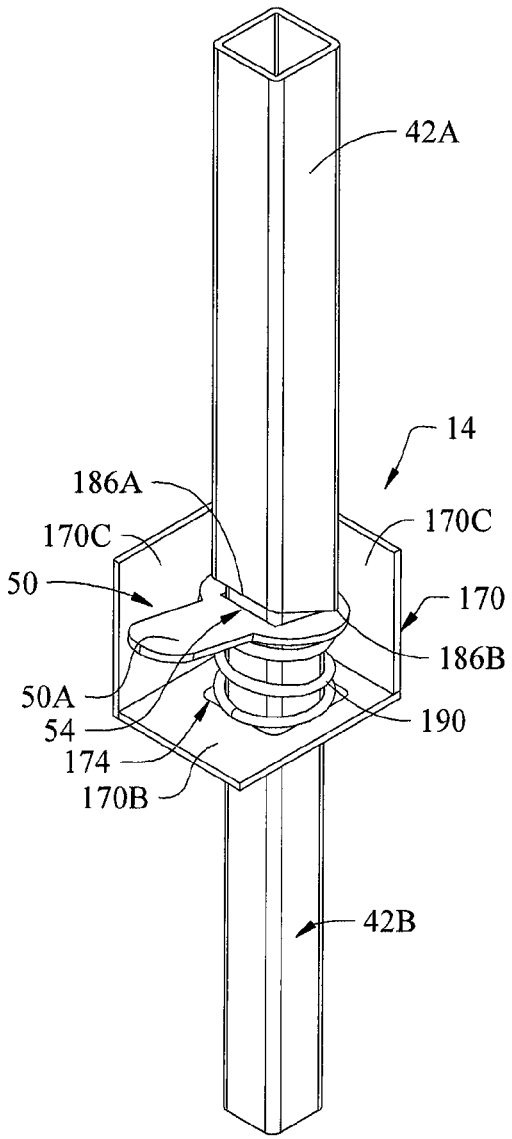
FIG. 6B is an isometric view of the locking mechanism shown in FIG. 6A being configured in an engaged position, wherein a portion of a housing is removed from view for clarity, in accordance with various embodiments of the present disclosure.
Figure 6C:
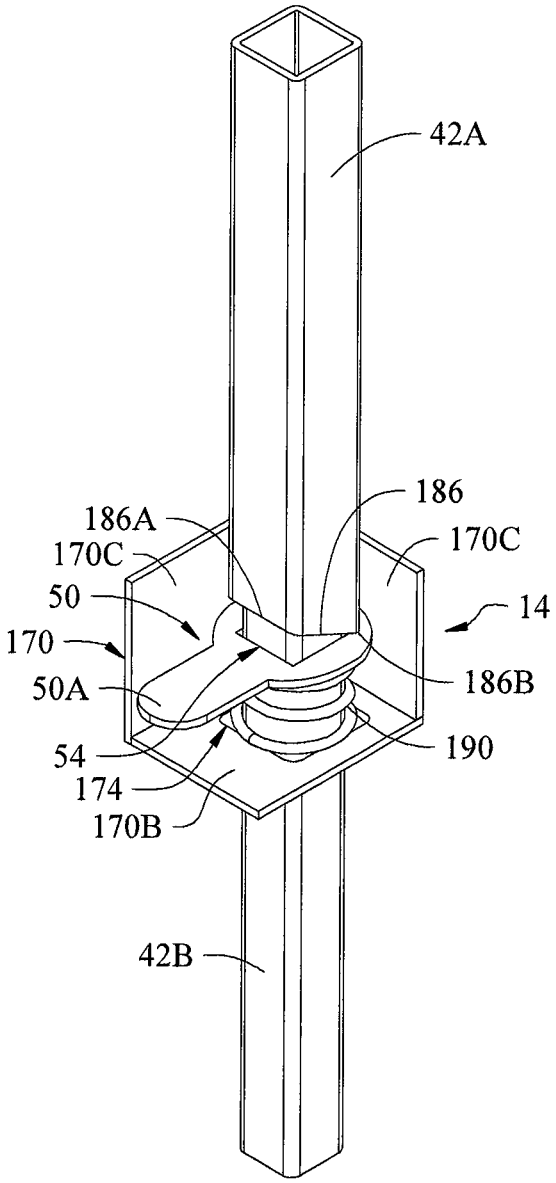
FIG. 6C is an isometric view of the locking mechanism shown in FIG. 6A being configured in a disengaged position, wherein a portion of the housing is removed from view for clarity, in accordance with various embodiments of the present disclosure.

Referring now to FIGS. 6A, 6B and 6C, in various embodiments, the locking mechanism 14 does not rely on the position of the seat frame 46 to engage and disengage the locking key 50. In such embodiments, the locking mechanism includes a housing 170 that is fixedly connected to the upper back leg tube 42A and sliding engaged or not in contact with the lower back leg tube 42B. Particularly, the housing 170 includes a top plate 170A that is connected to a bottom plate 170B via three sidewalls 170C and a rear wall 170D, wherein the top plate 170A is fixedly connected to, or integrally formed with, the upper back leg tube 42A and the bottom plate 170B includes an aperture 174 through which the lower back leg tube 42B freely extends. The rear wall 170D includes a window 178 through which the tongue 50A of the locking key 50 extends such that the tongue 50A can be manipulated by a user of the chair 10.

Furthermore, in such embodiments, a bottom end 186 of the upper back leg tube 42A is angled relative to a longitudinal axis of the upper back leg tube 42A. That is, a trailing edge 186A of the bottom end 186 is nearer a longitudinal center of the upper back leg tube 42A than a leading edge 186B of the bottom end 186. Still further, in such embodiments, the locking mechanism 14 includes an engagement spring 190 disposed between the bottom plate 170B of the housing and locking key 50 such that the engagement spring 190 applies a constant upward force on the locking key 50.

More specifically, the upward force provided by the engagement spring 190 is operable to maintain the locking key 50 in an engaged position, as shown in FIG. 6B, until a user applies a downward force (i.e., a force opposite that provided by the engagement spring 190) to move the locking key 50 to a disengaged position, as shown in FIG. 6C. When in the engaged position, the locking key 50 is forced by the engagement spring 190 into contact with the leading edge 186B and further forced into an angled or canted orientation such that the top surface of the locking key 50 is in contact with or substantially adjacent the bottom end 186 of the upper back leg tube 42A. That is, in a static state the locking key 50 is normally biased, or forced, by the engagement spring 190 to have an angled orientation relative to a longitudinal axis of the lower back leg tube 42B. Importantly, when in the angled orientation, i.e., in the engaged position, the locking aperture 54 pinches or binds the lower back leg tube 42B, thereby preventing, or at least greatly restricting, telescopic travel of the lower back leg tube 42B into the upper back leg tube 42A such that the respective back leg 42 is locked at a certain length L (FIG. 3).

To disengage the locking keys 50 from the lower back leg tubes 42B, the user merely places his/her thumb on the upper surface of the locking key tongue 50A that is extending through the rear wall window 178 and his/her forefinger in the bottom plate 170B of the housing 170 and squeezes to apply a downward force to the locking key tongue 50A. This downward force will oppose the upward force of the engagement spring 190 and disengage the locking key aperture 54 from pinching or binding the lower back leg tube 42B. Once disengaged, the lower back leg tube 42B is free to easily slide or travel within the locking key aperture 54 and telescopingly travel into and out of the upper back leg tube 42A to adjust the length L (FIG. 3) of the back frame 44, such that the deployed seat frame 46 can be placed in a desired orientation, e.g., a substantially horizontal orientation.

Figure 6D:
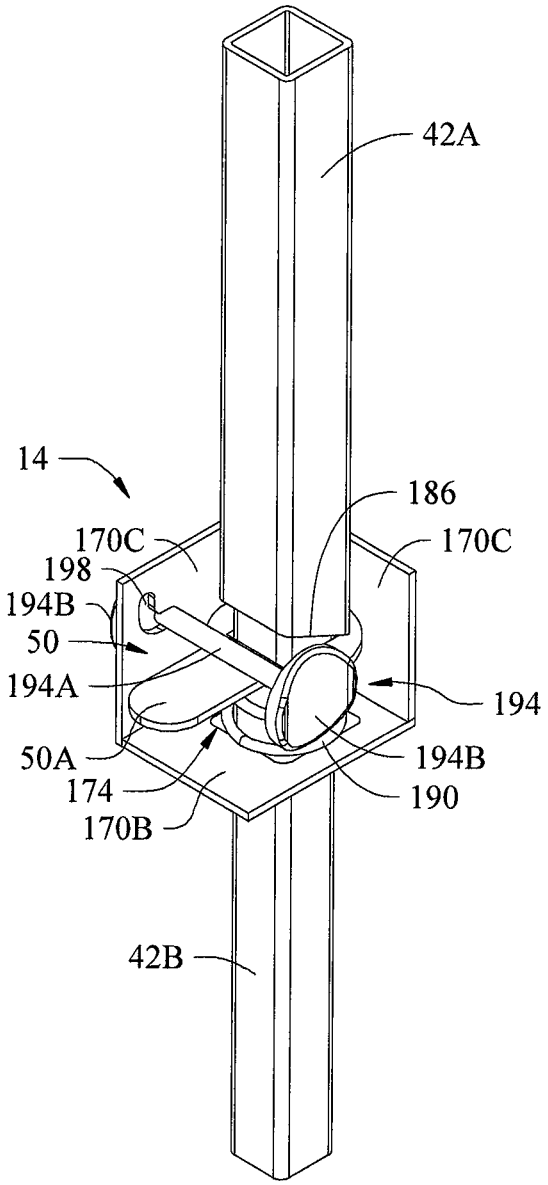
FIG. 6D is an isometric view of the locking mechanism shown in FIG. 6A including a disengagement lock, wherein a portion of the housing is removed from view for clarity, in accordance with various embodiments of the present disclosure.

Referring now to FIG. 6D, in various embodiments, the locking mechanism 14 illustrated in FIGS. 6A, 6B and 6C includes a disengagement lock 194 that is structured and operable to selectively hold the locking key 50 in the disengaged position. In such embodiments, opposing sidewalls 170C of the housing 170 include L-shaped apertures 198 through which a lock bar 194A extends. The disengagement lock 194 additionally includes a pair of release knobs 194B connected to, or formed at, opposing ends of the lock bar 194A. Particularly, the lock bar 194A extends through the L-shaped apertures 198 and the interior of the housing 170 such that the lock bar 194A is positioned above the locking key tongue 50A, and the side release knobs 194B are disposed exteriorly of sidewalls 170C such that a user can selectively position the lock bar 194A at a desired position within the L-shaped apertures 198 via the release knobs 194B.

As illustrated in FIG. 6D, the L-shaped apertures 198 include a horizontal leg and a vertical leg. The length and location of the horizontal leg within the sidewalls 170C is such that when the lock bar 194A is positioned within the horizontal legs, the locking key tongue 50A is retained by the lock bar 194A in a substantially horizontal position whereby the locking key 50 is maintained in the disengaged position. Moreover, the upward force of the engagement spring 190 on the locking key 50 will further apply an upward force on the lock bar 194A such that the lock bar 194A is retained within the horizontal legs of the L-shaped apertures 198 until the user physically moves the lock bar 194A out of the horizontal legs of the L-shaped apertures 198, via the release knobs 194B. Accordingly, the locking key 50 can be selectively locked into the disengaged position whereby the lower back leg tubes 42B can be easily telescopingly moved into or out of the upper back leg tubes 42A to adjust the length L of the back legs 42 to a desired length, i.e., configure the chair 10 in the desired collapsed or expanded position.

Once the back legs 42 have been set to a desired length, the user can utilize the release knobs 194B to move the lock bar 194A of the disengagement lock 194 into the vertical slots of the L-shaped apertures 198. Once the lock bar 194A is positioned within the vertical slots of the L-shaped apertures 198, the locking key 50 is no longer held in the disengaged position by the lock bar 194A and the upward force of the engagement spring 190 will move the locking key 50 into the engaged position, as described above.

Figure 6E:
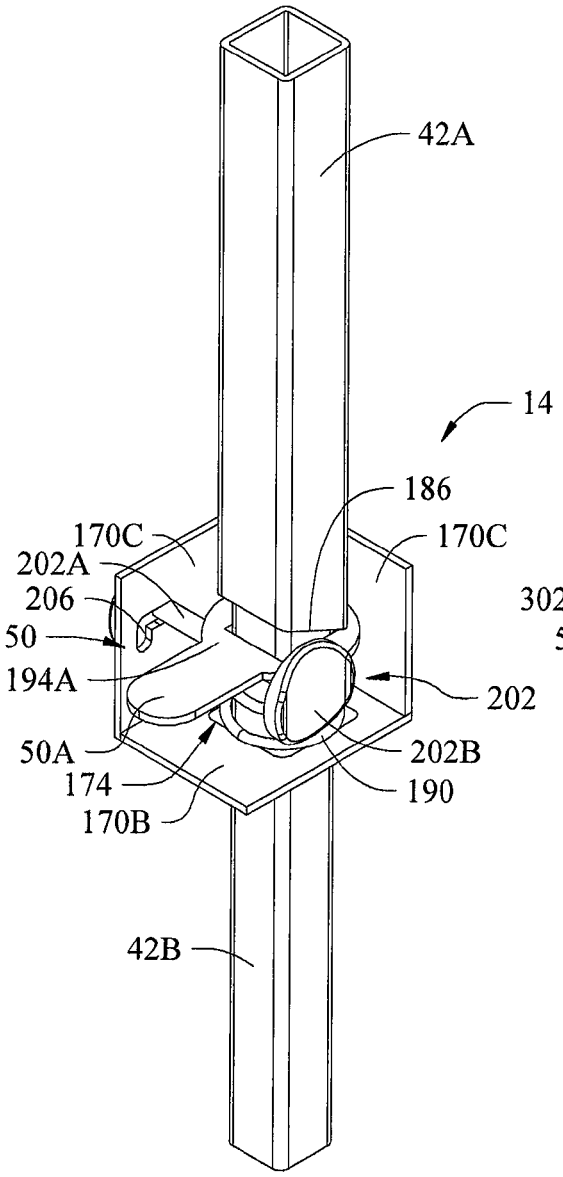
FIG. 6E is an isometric view of the locking mechanism shown in FIG. 6A including an engagement lock, wherein a portion of the housing is removed from view for clarity, in accordance with various embodiments of the present disclosure.

Referring now to FIG. 6E, in various embodiments, the locking mechanism 14 illustrated in FIGS. 6A, 6B and 6C includes an engagement lock 202 that is structured and operable to selectively hold the locking key 50 in the engaged position. In such embodiments, opposing sidewalls 170C of the hosing 170 include inverted L-shaped apertures 206 through which a lock bar 202A extends. The engagement lock 202 additionally includes a pair of engagement knobs 202B connected to, or formed at, opposing ends of the lock bar 202A. Particularly, the lock bar 202A extends through the inverted L-shaped apertures 206 and the interior of the housing 170 such that the lock bar 202A is positioned under the locking key tongue 50A, and the engagement knobs 202B are disposed exteriorly of sidewalls 170C such that an user can selectively position the lock bar 202A at a desired position within the inverted L-shaped apertures 206 via the engagement knobs 202B.

As illustrated in FIG. 6E, the inverted L-shaped apertures 206 include a horizontal leg and a vertical leg. The length and location of the horizontal leg within the sidewalls 170C is such that when the lock bar 202A is positioned within the horizontal legs, the locking key tongue 50A is retained by the lock bar 202A in a canted position whereby the locking key 50 is maintained in the engaged position. Accordingly, once the back legs 42 are adjusted to a desired length L and the locking keys 50 are engaged, as described above, the locking keys 50 can be selectively locked into the engaged position by the user moving the lock bars 202A of the respective engagement locks 202 from the vertical legs of the respective inverted L-shaped apertures 206 to the horizontal legs of the respective inverted L-shaped apertures 206. Particularly, once the lock bars 202A are positioned in the horizontal legs of the inverted L-shaped apertures 206 the locking key tongues 50A are prevented by the lock bars 202A from being pushed downward to disengage the respective locking keys 50.

Figure 6F:
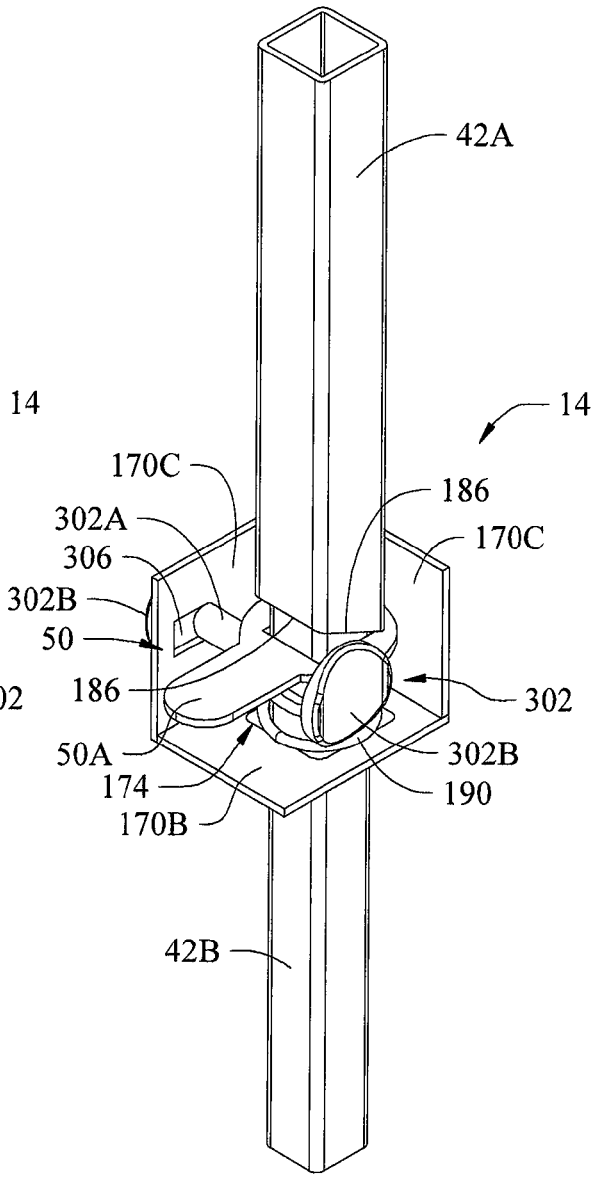
FIG. 6F is an isometric view of the locking mechanism of the chair shown in FIG. 6A, wherein a portion of the housing is removed from view for clarity, in accordance with other embodiments of the present disclosure.
Figure 6G:
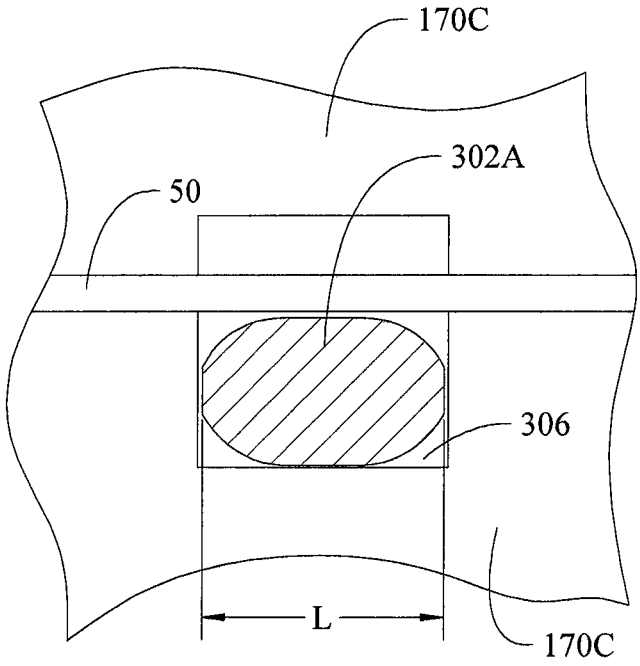
FIG. 6G is partial cross-sectional view of the locking mechanism shown in FIG. 6F in a disengaged orientation and having a lock bar having oval cross-section, wherein a portion of the housing is removed from view for clarity, in accordance with various embodiments of the present disclosure.
Figure 6H:
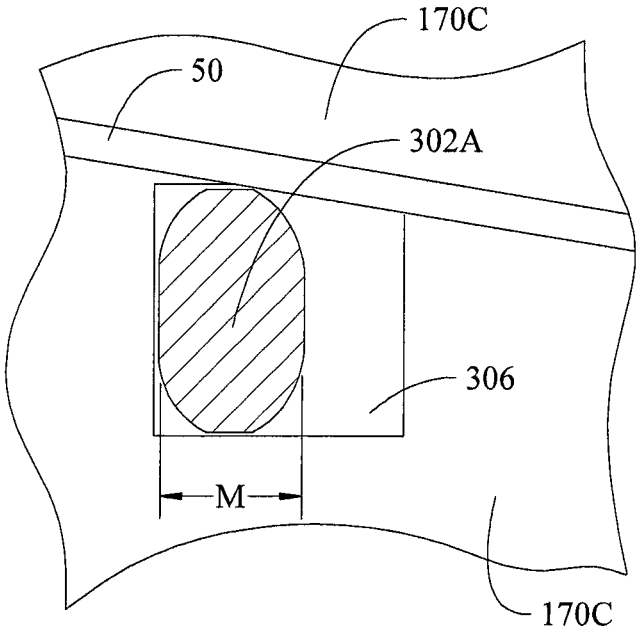
FIG. 6H is partial cross-sectional view of the locking mechanism shown in FIG. 6F in an engaged orientation, wherein a portion of the housing is removed from view for clarity, in accordance with various embodiments of the present disclosure.

Referring now to FIGS. 6F, 6G and 6H, in various other embodiments, wherein locking mechanism 14 is structured and operable to hold the locking key 50 in the engaged position, the locking mechanism 14 includes an engagement lock 302 comprising a lock bar 302A that is structured to have a substantially oval lateral cross-section (see FIGS. 6G and 6H) having an long dimension L and a short dimension M. In such embodiments, opposing sidewalls 170C of the hosing 170 include square or rectangular apertures 306 through which a lock bar 302A extends. The engagement lock 302 additionally includes a pair of engagement knobs 302B connected to, or formed at, opposing ends of the lock bar 302A. Particularly, the lock bar 302A extends through the square or rectangular apertures 306 and the interior of the housing 170 such that the lock bar 302A is positioned under the locking key tongue 50A, and the engagement knobs 302B are disposed exteriorly of sidewalls 170C. Importantly, a user can selectively rotate one or both of the engagement knobs 302B to selectively rotate or position the lock bar 302A in a desired orientation having the long dimension L substantially vertical or a desired orientation having the long dimension L substantially horizontal within the apertures 306.

As illustrated in FIGS. 6F and 6H, when the lock bar 302A is rotated such that it is oriented having the long dimension L substantially vertical, i.e., substantially parallel to the longitudinal axis of the chair back legs 42, the lock bar 302A is operable to selectively hold the locking key 50 in the engaged position. That is, when the engagement lock 202 is rotated, via the engagement knobs 302B, such that the long dimension L is substantially vertical, the lock bar 302A forces the locking key tongue 50A upward such that the locking key 50 is canted, i.e., placed in the engaged position, whereby the locking aperture 54 binds or pinches the lower back leg tube 42B, as described above, to lock the back leg 42 at the desired length L. Furthermore, the lock bar 302A will maintain the locking key 50 in the engaged position until the engagement lock 202 is disengaged, as described below. Particularly, once the lock bar 302A is positioned with the long dimension L substantially vertical within the apertures 306, the locking key tongue 50A is prevented by the lock bar 302A from being pushed downward to disengage the respective locking key 50.

As illustrated in FIG. 6G, when the lock bar 302A is rotated, via the engagement knobs 302B, such that the long dimension L is substantially horizontal, i.e., substantially orthogonal to the longitudinal axis of the chair back legs 42, the lock bar 302A is operable to allow the locking key 50 to disengaged from the lower back leg tube 42B such that the lower back leg tube 42B can freely move into and out of the upper back leg tube 42A.

Figure 7C:
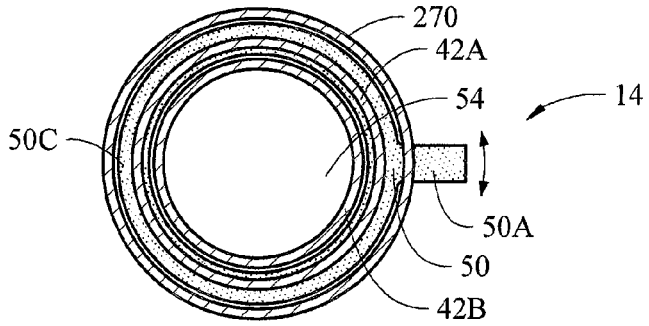
FIG. 7C is a top view of the locking mechanism shown in FIGS. 7A and 7B, in accordance with various embodiments of the present disclosure.
Figure 7A:
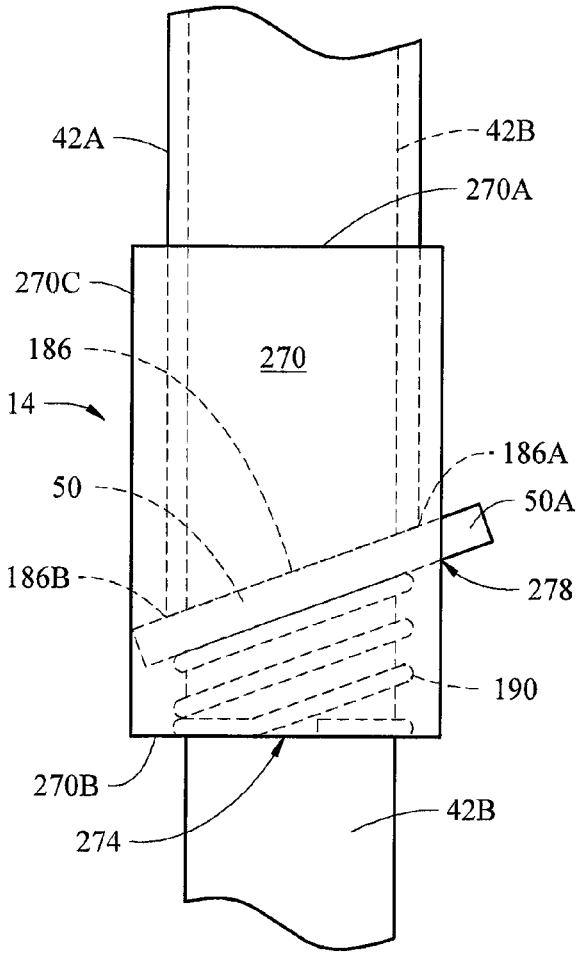
FIG. 7A is a side view of the locking mechanism of the chair shown in FIGS. 1A and 1B, in accordance with still yet other embodiments of the present disclosure.
Figure 7B:
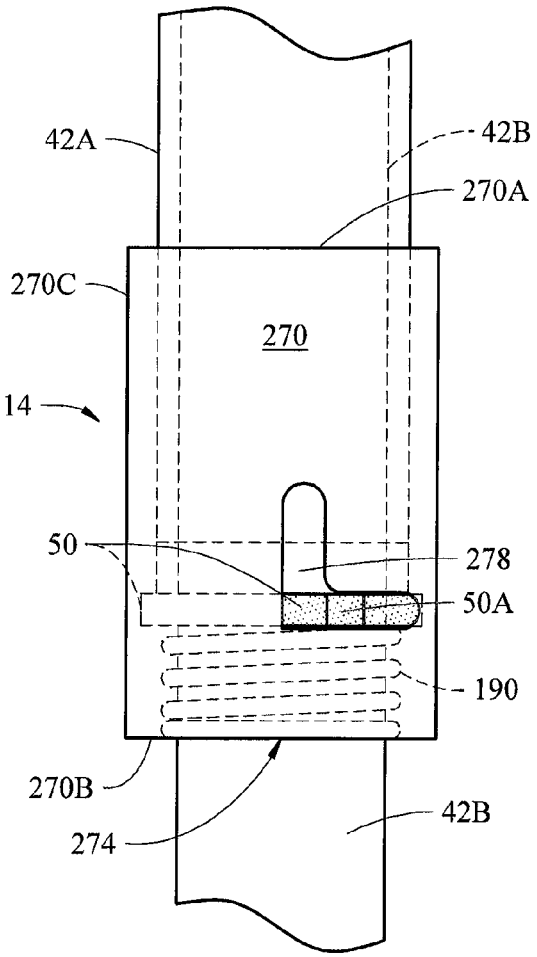
FIG. 7B is another side view of the locking mechanism shown in FIG. 7A, in accordance with various embodiments of the present disclosure.

Referring now to FIGS. 7A, 7B and 7C, in various other embodiments, the locking mechanism 14 again does not rely on the position of the seat frame 46 to engage and disengage the locking key 50. In such embodiments, the locking mechanism includes a housing 270 that is fixedly connected to the upper back leg tube 42A and sliding engaged or not in contact with the lower back leg tube 42B. Particularly, the housing 270 includes a top plate 270A that is connected to a bottom plate 270B via at least one sidewall 270C, e.g., the housing 270 can be cylindrical, wherein the top plate 170A is fixedly connected to, or integrally formed with, the upper back leg tube 42A and the bottom plate 170B includes an aperture 274 through which the lower back leg tube 42B freely extends. The sidewall 270C includes an L-shaped aperture 278 through which the tongue 50A of the locking key 50 extends such that the tongue 50A can be manipulated by a user of the chair 10.

Furthermore, in such embodiments, a bottom end 186 of the upper back leg tube 42A is angled relative to the longitudinal axis of the upper back leg tube 42A. That is, a trailing edge 186A of the bottom end 186 is nearer a longitudinal center of the upper back leg tube 42A than the leading edge 186B of the bottom end 186. Still further, in such embodiments, the locking mechanism 14 includes the engagement spring 190 disposed between the bottom plate 170B of the housing and locking key 50 such that the engagement spring 190 applies a constant upward force on the locking key 50. Still yet further, in such embodiments, the locking key 50 and the locking aperture 54 of the locking key 50 are sized and/or structured such that the locking key 50 can rotate about the lower back leg tube 42B and within the housing 270 when the locking key 50 is in the disengaged position, as shown in FIG. 7C. For example, in various implementations, the housing 270 can be cylindrical, and the outside perimeter of the locking key body 50C and the locking aperture 54 can be circular such that the locking key 50 can rotate about the lower back leg tube 42B and within the housing 270 when the locking key 50 is in the disengaged position. The cross-sectional shape of the upper and lower back leg tubes 42A and 42B can have any desired shape, e.g., circular, square, hexagonal, etc., as long as the locking aperture 54 is sized to allow the locking key 50 to rotate about lower back leg tube 42B.

As illustrated in FIG. 7B, the L-shaped aperture 278 includes a horizontal leg and a vertical leg. The length and location of the horizontal leg within the sidewall 270C is such that when the locking key tongue 50A is positioned within the horizontal leg, the locking key 50 is retained in a substantially horizontal position, i.e., the locking key 50 is maintained in the disengaged position, as shown in FIG. 7B. Moreover, the upward force of the engagement spring 190 will retain the locking key tongue 50A within the horizontal leg of the L-shaped aperture 278 until the user physically moves the tongue 50A out of the horizontal leg. Accordingly, the locking key 50 can be selectively locked into the disengaged position whereby the lower back leg tubes 42B can be easily telescopingly moved into or out of the upper back leg tubes 42A to adjust the length L of the back legs 42 to a desired length, i.e., configure the chair 10 in the desired collapsed or expanded position.

To engage the locking key 50, the locking key tongue 50A is moved along the horizontal leg to rotate the locking key 50 within the housing 270 about the lower back leg tube 42A until the tongue 50A is positioned within the vertical leg of the L-shaped aperture 278. Subsequently, the upward force provided by the engagement spring 190 will force the locking key tongue 50A upward within the vertical leg of the L-shaped aperture 278, and thereby position and maintain the locking key 50 in the engaged position, as shown in FIG. 7A. When in the engaged position, the locking key 50 is forced by the engagement spring 190 into contact with the leading edge 186B and further forced into an angled or canted orientation such that the top surface of the locking key 50 is in contact with or substantially adjacent the bottom end 186 of the upper back leg tube 42A. Importantly, when in the angled/canted orientation, i.e., in the engaged position, the locking aperture 54 pinches or binds the lower back leg tube 42B, thereby preventing, or at least greatly restricting, telescopic travel of the lower back leg tube 42B into the upper back leg tube 42A such that the respective back leg 42 is locked at a certain length L (FIG. 3).

To disengage the locking keys 50 from the lower back leg tubes 42B, the user merely pushes downward on the locking key tongue 50A to move the tongue 50A down in the vertical leg of the L-shaped aperture 278 to disengage the locking key 50 from binding/pinching the lower back leg tube 42B. The user then slides the tongue 50A sideways into the horizontal leg of the L-shaped aperture 278 to maintain the locking key 50 in the disengaged position.

Once disengaged, the lower back leg tube 42B is free to easily slide or travel within the locking key aperture 54 and telescopingly travel into and out of the upper back leg tube 42A to adjust the length L (FIG. 3) of the back frame 44, such that the deployed seat frame 46 can be placed in a desired orientation, e.g., a substantially horizontal orientation.

Referring now to FIGS. 1A, 1B and 6A through 7C, to position the chair 10 in the expanded position on a sloped surface 12, e.g., a sloped ground surface, the user simply positions the back lower cross member 70 on the surface 12 and pushes the seat frame 46 forward causing the front lower cross member 74 to contact the surface 12. Subsequently, the user steps on the back lower cross member 70 to hold the back lower cross member 70 firmly in contact with the surface 12, disengages the locking keys 50, as described above, and gently pulls upward on the respective locking mechanisms 14 and/or the upper back leg tubes 14A and/or the upper back upper cross member 82 causing the upper back leg tubes 42A to be telescopingly extended upward from the lower back leg tubes 42B, and vice versa. Once the lower back leg tubes 42B have been extended from the upper back leg tubes 42A such that the back legs 42 have the desired length L, whereby that the seat frame 46 is in a desired orientation, e.g., substantially horizontal, the user engages the locking keys 50 with the lower back leg tubes 42B, as described above, thereby placing the locking mechanisms 14 in the engaged configuration.

To disengage the locking mechanism 14, the user simply stands up to relieve the pressure of his/her weight off the locking keys 50. The user then can grasp the front of the seat frame 46 and the top of the back frame 44 and simultaneously pull the front of the seat frame 46 and the top of the back frame 44 toward each other. The user can then easily disengage the respective locking keys 50 from the lower back leg tubes 42B, as described above, and push downward on the back upper cross member 82 to telescopingly force the lower back leg tubes 42B into the upper back leg tubes 42B, thereby placing the chair 10 in the collapsed position.

As described above, in various embodiments, the locking mechanism 14 can include a leveling spring 66 that is structured and operable to apply pressure to the back end 50B of the locking key 50. The pressure applied by the leveling spring 66 maintains the locking key 50 in a substantially level position when the locking key 50 is in the disengaged position, such that the lower back leg tubes 42B are able to smoothly slide within the locking aperture 54. Hence, the leveling springs 66 prevent 'chattering' of the locking keys 50 on the lower back leg tubes 42B as the chair 10 is transitioned between the collapsed position and an expanded position.

Although the various embodiments of the locking mechanism 14 have describe above for use in adjusting and maintaining the length L of the back legs 42 of the chair 10, such that the chair 10 will stably provide a substantially horizontal seating surface for a person to sit while the chair 10 is disposed on an angled or sloped surface 12, it is envisioned that the locking mechanism 14, as described above, can be used with any telescoping pole, rod, tubing, leg, etc. That is, locking mechanism 14, as described above, can be implemented with any device, mechanism, apparatus or system that includes one or more telescoping poles, rods, tubings, legs, etc., to adjust the respective telescoping poles, rods, tubings, legs, etc., to a desired length and maintain the respective telescoping poles, rods, tubings, legs, etc., at the desired length. More specifically, when the locking mechanism 14 is implemented in such devices, mechanisms, apparatuses or systems and configured in the engaged position, the locking mechanism 14 will maintain the desired length of the respective telescoping pole, rod, tubing, leg, etc., and prevent, or at least greatly restrict, telescopic travel of the inner tube of the respective telescoping pole, rod, tubing, leg, etc. into the outer tube of the respective telescoping pole, rod, tubing, leg, etc.

Subsequently, to allow telescopic travel of the inner tube into and out of the outer tube of the respective telescoping pole, rod, tubing, leg, etc. the locking mechanism 14 can be disengaged as described above.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A chair configurable to provide a substantially horizontal seating surface when the chair is disposed on an angled surface, said chair comprising:

- a back frame comprising a pair of telescoping back legs, each back leg including an upper back leg tube and a lower back leg tube that slidingly disposed within the upper back leg tube;
- a seat frame pivotally connected to the back frame such that the seat frame can be transitioned between a collapsed position and an expanded position;
- a pair of front legs having the seat frame pivotally connected thereto; and
- a pair of locking mechanisms, each locking mechanism fixedly connected to a respective one of the upper back leg tubes and comprising:
  - a locking key, each locking key including:
    - a locking aperture through which the respective lower back leg tube extends; and
    - a tongue structured and operable to control selectively positioning the respective locking key into each of:
      - an engaged position that binds the lower back leg tube within the locking aperture such that the lower back leg tube cannot slide into the upper back leg tube, and
      - a disengaged position that allows the lower back leg tube to freely slide within the locking aperture and the upper back leg tube;
  - a hinge bracket fixedly attached to the upper back leg tube and at least partially encloses, in a non-contact manner, a portion of the lower back leg tube that is adjacent a lower end of the upper back leg tube, the seat frame being pivotally connected to the hinge bracket; and
  - a fulcrum pad disposed on the respective locking key tongue such that as the seat frame is transitioned from a collapsed position to an expanded position, the seat frame contacts the fulcrum pads moving the respective locking keys into the engaged position.

2. The chair of claim 1 further comprising an anchoring and stabilizing mechanism mounted to a back lower cross member of the back frame, the anchoring and stabilizing mechanism structured and operable to selectively provide additional stability to the chair on the angled surface.

3. A chair configurable to provide a substantially horizontal seating surface when the chair is disposed on an angled surface, said chair comprising:

a back frame comprising a pair of telescoping back legs, each back leg including an upper back leg tube and a lower back leg tube that slidingly disposed within the upper back leg tube;

a seat frame pivotally connected to the back frame such that the seat frame can be transitioned between a collapsed position and an expanded position;

a pair of front legs having the seat frame pivotally connected thereto;

a pair of locking mechanisms, each locking mechanism fixedly connected to a respective one of the upper back leg tubes and comprising:

a locking key, each locking key comprising:

a locking aperture through which the respective lower back leg tube extends; and a tongue structured and operable to selectively position the respective locking key into each of:

an engaged position that binds the lower back leg tube within the locking aperture such that the lower back leg tube cannot slide into the upper back leg tube, and a disengaged position that allows the lower back leg tube to freely slide within the locking aperture and the upper back leg tube;

a hinge bracket fixedly attached to the upper back leg tube and at least partially encloses, in a non-contact manner, a portion of the lower back leg tube that is adjacent a lower end of the upper back leg tube, the seat frame being pivotally connected to the hinge bracket; and a fulcrum pad disposed on the respective locking key tongue such that as the seat frame is transitioned from a collapsed position to an expanded position, the seat frame contacts the fulcrum pads moving the respective locking keys into the engaged position; and an anchoring and stabilizing mechanism mounted to a back lower cross member of the back frame, that is structured and operable to selectively provide additional stability to the chair on the angled surface.

* * * * *